United States Patent [19]

Stone

[11] 4,129,302

[45] Dec. 12, 1978

[54] GAME OF SKILL

[76] Inventor: Gregory B. Stone, 48 Rue Jacob, Paris, France, 75006

[21] Appl. No.: 786,618

[22] Filed: Apr. 11, 1977

[30] Foreign Application Priority Data

Apr. 13, 1976 [GB] United Kingdom ..... 15089/76

[51] Int. Cl.[2] ..... A63F 3/00

[52] U.S. Cl. ..... 273/236; 273/282; 273/287

[58] Field of Search ..... 273/130 R, 156, 157 R, 273/236, 282, 287

[56] References Cited

U.S. PATENT DOCUMENTS

| | | | |
|---|---|---|---|
| 539,906 | 5/1895 | Sargent | 273/130 R |
| 787,320 | 4/1905 | Arthur | 273/157 R UX |
| 2,188,480 | 1/1940 | Murray | 273/130 R |
| 2,377,100 | 5/1945 | Patterson | 273/156 UX |
| 2,494,469 | 1/1950 | Booth | 273/130 R UX |
| 3,698,122 | 10/1972 | Adams | 46/17 |
| 3,853,323 | 12/1974 | Gifford | 273/137 R |
| 3,909,003 | 9/1975 | Rabinovich | 273/157 R |

*Primary Examiner*—Anton O. Oechsle
*Attorney, Agent, or Firm*—Browdy and Neimark

[57] ABSTRACT

A game requiring (a) two distinguishable sets having the same number of playing pieces, the pieces of each set being of various lengths corresponding to consecutive values in a Fibonacci series, e.g. 1:1:2:3:5:8, and (b) a measure adapted to receive the playing pieces laid end-to-end; and wherein, with each player in turn placing a selected piece so as to form a growing column of pieces laid end-to-end extending along the measure, the objective is to force the other player to cause the column to reach or exceed a chosen marked length on the measure.

10 Claims, 2 Drawing Figures

GAME OF SKILL

Figure 1:
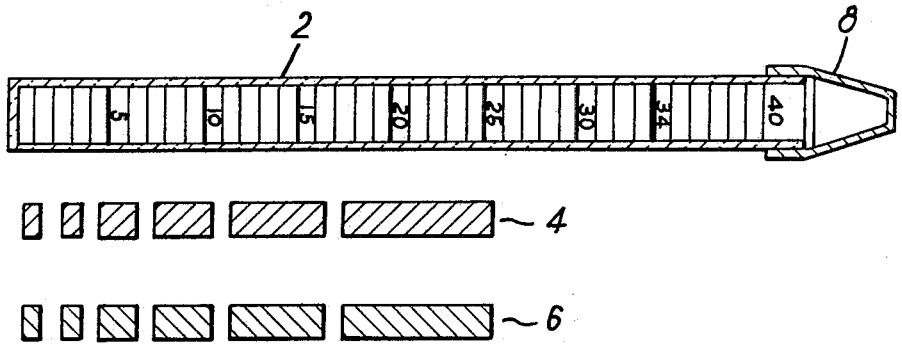

This invention relates to a game of skill. The game is preferably for two players although modifications thereof can be played by three or more players.

In mathematics, the series of numbers 1, 1, 2, 3, 5, 8 and so on, in which in respect of any three adjacent members of the series the value of the highest member is the sum of the values of the other two members, is known as the Fibonacci series.

The game utilizes the relationships between these associated numbers.

In accordance with the invention, in the game suitable for two players, there are provided two sets of playing pieces, one for each player, the sets having the same number of playing pieces and being distinguished from each other by a characteristic such as color and each set comprising pieces of various lengths corresponding to consecutive values in the Fibonacci series.

The game also includes a measure adapted to receive the playing pieces arranged end-to-end with respect to their length, the measure having a marked length corresponding to another value in the Fibonacci series, this value being less than the total obtained by summing the values of the pieces of both sets but greater than half that total.

By way of example, each set may contain six pieces whose lengths are related to each other by the ratios 1:1:2:3:5:8. The possible values for the marked lengths of the measure will then be values in the same Fibonacci series and lying between 20 and 40; i.e. 21 and 34.

In one preferred example, the marked length on the measure represents the highest value in the Fibonacci series below the total obtained by summing together the values of the pieces of the two sets. Thus, in the example just referred to, this value is 34.

To play the game, the first player chooses one of his pieces and places it on or in the measure so that it occupies a part of the marked length extending from the beginning of that length. The second player then lays one of his pieces with an end against the end of the first piece so that it occupies a further part of the marked length. The players then continue to take turn and turn about each to lay a piece from his set against the end of the previously laid piece so that a growing column of pieces is assembled which extends along the marked length of the measure.

The object of the game is for each player by selection of the order of play of his pieces to attempt to force the other player to lay the piece which causes the column of pieces to reach or extend beyond the end of the marked length of the measure.

Increased game opportunities may be achieved by providing a choice of target values which may or may not be members of the Fibonacci series.

In this version of the game, the players may jointly agree on a target value or alternatively it may be agreed that whichever of the players does not have the choice of starting first or second has the choice of target value.

For this version, the measure should also contain at least one and preferably several marked lengths (other than those corresponding to the Fibonacci value or values referred to above) each such marked length being a whole multiple of the length of the shortest playing piece. Suitably, the measure can be divided into units of length equal to the length of the shortest playing piece, optionally with certain values, e.g. corresponding to those presenting a particular challenge, being marked in a distinctive manner. To provide a degree of difficulty the selected target values are preferably in the range of from two above the value of the highest value playing piece to four below the value obtained by summing the values of the pieces of both sets, and the measure is marked in units of length at least in that range. Thus, in the case illustrated above, where each set comprises six pieces, having lengths related to each other by the ratios 1:1:2:3:5:8, the preferred range is from 10 to 36 inclusive. Values outside this range may also be chosen but the resulting game is less interesting. Within the recommended range, the values of 31, 33, 34 and 36 provide special challenges with the aforementioned value of 34 being of particular relevance since it is a Fibonacci number.

The pieces, which may suitably be of wood, plastics or metal, may suitably be, for example, hollow or solid cylinders or other hollow or solid shapes of regular cross-section such as prisms. The lengths of the pieces in each set are related to each other in the above-described fashion, e.g. in the ratio 1:1:2:3:5:8.

The measure may be provided in a form suited to the shape of the pieces. For example, where the pieces are in the form of solid shapes of regular cross-section, such as cylinders or prisms, the measure suitably comprises a hollow tube which corresponds in cross-section to the pieces and has a cross-sectional size such that it will receive the pieces as a loose sliding fit in end-to-end relationship extending along the axis of the tube. The tube preferably has a translucent or transparent section which extends along its length and about at least a part of its circumference so that the growing column of pieces placed in the tube during play can be viewed from outside.

The tube, which is preferably of clear plastics material, preferably is of sufficient length to house all the playing pieces packed end-to-end, thus providing a container for the pieces, and preferably has a closure means such as a cap. The cap may be formed to also provide a stand for the tube when placed over the closed end of the tube, and the tube is preferably marked off along its length in units of length equal to the length of the shortest playing piece. This unit length may conveniently be a standard length e.g. ⅛ inch or 2mm, so that the measure may also be used literally as such.

Preferably, the tube is of a size that it is easily portable, e.g. fitting into a jacket pocket.

The tube may also form a part of a writing implement, e.g. pen or pencil, if desired.

In an alternative embodiment, each piece may be provided with an axial bore extending through its length, e.g. as in a hollow cylinder and the measure may then comprise a rod of suitably shaped cross-section over which the pieces may be slid.

In this form, the components of the game may be provided in a form and size suitable for use on a table or like surface, with the measure extending vertically; for example for playing in a club or public house or other meeting place.

In yet another embodiment, the measure may comprise a groove or channel in a board and in which the pieces may be laid end-to-end.

Figure 2:
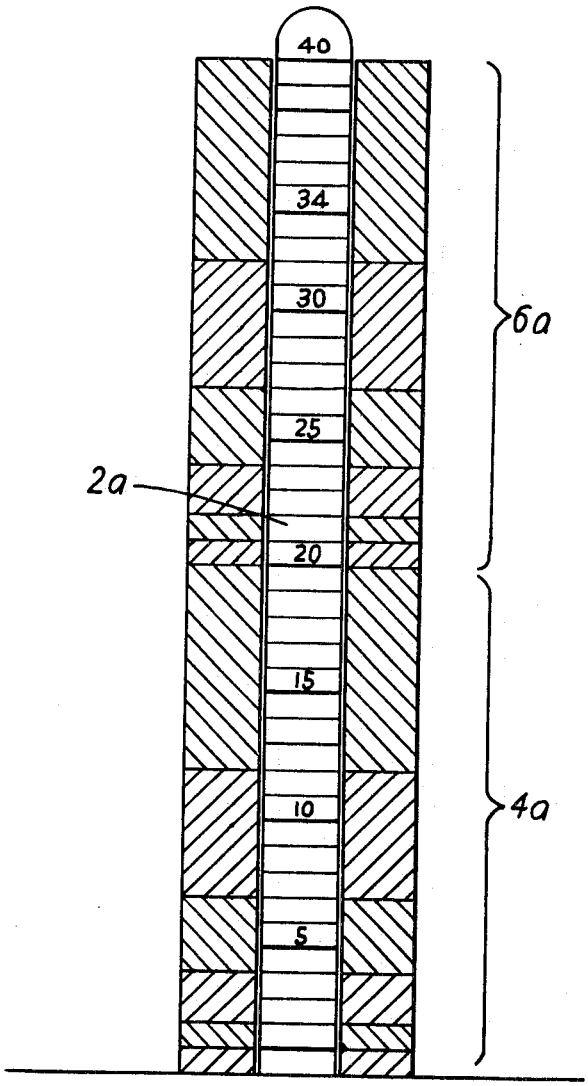

The invention is illustrated with reference to two preferred embodiments and with the aid of the accompanying drawings in which FIG. 1 illustrates one embodiment chosen for its suitability for portability and FIG. 2 illustrates an alternative embodiment suitable for playing the game in a club or the like meeting place.

In the embodiment shown in FIG. 1, the components of the game consist of a transparent plastics tube 2, which is open at one end and is conveniently about 1cm in diameter and 10–15cm long, and two sets of playing pieces 4 and 6, each comprising six cylinders all of the same diameter but of differing lengths in the proportions 1:1:2:3:5:8. The sets are distinguished from each other by color, indicated by the different shadings in the drawing. Starting from the closed end, the tube 2 is divided axially into units of length corresponding to the length of the shortest of the playing pieces and several of the divisions are indicated in a special manner. In particular, division No. 34 is marked heavily as being the preferred target value for the game. Other values providing particular challenges for use with a set of six pieces in the aforementioned ratios are 31, 33 and 36.

The tube 2 is sufficiently long to accommodate all the pieces of both sets and a cap 8 is provided to fit over the end of the tube.

In the embodiment illustrated in FIG. 2, the measure is a vertical rod 2*a* suitably anchored, and the playing pieces 4*a*, 6*a* are sleeves which are a sliding fit over the rod 2*a*.

The game may be modified for play by three or more players. In this case, three or more sets of pieces are provided, one for each player. The favored marked length of the measure for this version of the game will correspond to a value in the Fibonacci series which exceeds the sum of the corresponding values of one set of pieces but is less than the sum of the corresponding values of the pieces of all the sets in play. Preferably the value of the dimension of the measure will exceed the sum of the values of n-1 sets where n corresponds to the number of sets in play.

In another alternative, more than one measure may be used. Each player may then select which of the measures he will place his piece against at each play that he makes and may vary his selection with each play that he makes. In this variant of the game, the objective is to avoid being forced to play a piece which causes the total value of the pieces played against any of the measures to reach or pass a marked length on that measure. In this variant, the marked lengths of the measures should be identical to each other and must be such that their total is less than the sum of the values of the pieces of all the sets in play.

For these last two alternatives, to provide increased game opportunities, as described above in respect of the game for two players, the measure or each of the measures may also contain marked lengths other than those corresponding to Fibonacci values, each marked length being a whole multiple of the length of the shortest playing piece. Suitably, the measure or each of the measures may be divided into units of length equal to the length of the shortest playing piece.

It will be understood that the target values on each of the measures in use, where more than one measure is being used in the game, should be the same.

It will be apparent that other game variations are possible using the basic components of measure and playing pieces of the invention.

I claim:

1. A game of skill including two sets of playing pieces each having the same number of pieces, the pieces being of regular cross-section, the sets being distinguished from each other by a characteristic, and each set comprising pieces of various lengths to represent consecutive values in the Fibonacci series; and a measure which comprises a hollow tube which is transparent or translucent about at least a part of its circumference and along the length and is adapted to receive the playing pieces as a loose sliding fit in end-to-end relationship extending along the axis of the tube inside the tube the measure having a marked length corresponding to another value in the Fibonacci series, this value being less than the total obtained by summing together the values of the pieces of the two sets but greater than half that total.

2. A game as claimed in claim 1 in which the marked length on the measure represents the highest Fibonacci value below the total obtained by summing together the values of the pieces of the two sets.

3. A game as claimed in claim 1 in which the measure also contains at least one other marked length, each such length being equal to a whole multiple of the length of the shortest playing piece.

4. A game as claimed in claim 1, in which the measure is divided into units of length equal to the length of the shortest playing piece, at least in the range from the value corresponding to 2 above the value of the highest value playing piece to the value corresponding to 4 below the total obtained by summing together the values of the pieces of the two sets.

5. A game as claimed in claim 1 wherein the distinguishing characteristic of the sets is color.

6. A game of skill including two sets of playing pieces each having the same number of pieces and each piece containing an axial bore through its length, the sets being distinguished from each other by a characteristic, and each set comprising pieces of various lengths to represent consecutive values in the Fibonacci series; and a measure adapted to receive the playing pieces arranged end-to-end with respect to their length and comprising a rod over which the pieces can be slid, the measure having a marked length corresponding to another value in the Fibonacci series, this value being less than the total obtained by summing together the values of the pieces of the two sets but greater than half that total.

7. A game as claimed in claim 6 in which the marked length of the measure represents the highest Fibonacci value below the total obtained by summing together the values of the pieces of the two sets.

8. A game as claimed in claim 6, in which the measure also contains at least one other marked length, each such length being equal to a whole multiple of the length of the shortest playing piece.

9. A game as claimed in claim 6 in which the measure is divided into units of length equal to the length of the shortest playing piece, at least in the range from the value corresponding to 2 above the value of the highest value playing piece to the value corresponding to 4 below the total obtained by summing together the values of the pieces of the two sets.

10. A game as claimed in claim 6, wherein the distinguishing characteristic of the sets is color.

* * * * *